US006422413B1

(12) United States Patent
Hall et al.

(10) Patent No.: US 6,422,413 B1
(45) Date of Patent: Jul. 23, 2002

(54) TANK VAULT

(76) Inventors: William Y. Hall, 1360 Capitol Dr. #135, San Pedro, CA (US) 90732; William A. Hall, 2104 Paseo Del Mar, Palos Verdes Estates, CA (US) 90274

( * ) Notice: Subject to any disclaimer, the term of this patent is extended or adjusted under 35 U.S.C. 154(b) by 0 days.

(21) Appl. No.: 08/348,744

(22) Filed: Nov. 30, 1994

Related U.S. Application Data

(63) Continuation of application No. 08/028,213, filed on Mar. 9, 1993, now abandoned, which is a continuation of application No. 07/946,026, filed on Sep. 15, 1992, now Pat. No. 5,271,473, which is a continuation of application No. 07/759,703, filed on Sep. 11, 1991, now abandoned, which is a continuation of application No. 07/664,411, filed on Feb. 27, 1991, now abandoned, which is a continuation of application No. 07/452,690, filed on Dec. 19, 1989, now abandoned.

(51) Int. Cl.[7] ..... B65D 90/00

(52) U.S. Cl. ..... 220/567.2; 220/565; 220/567.1; 220/4.12

(58) Field of Search ..... 220/565, 444, 220/469, 4.12, 455, 567.1, 567.2; 206/509

(56) References Cited

U.S. PATENT DOCUMENTS

| | | | | | |
|---|---|---|---|---|---|
| 806,458 | A | | 12/1905 | Brady | |
| 1,024,527 | A | * | 4/1912 | Searle | 52/123 |
| 1,056,955 | A | | 3/1913 | Stamm | |
| 1,153,535 | A | | 9/1915 | Babrick | |
| 1,180,367 | A | | 4/1916 | Babick | |
| 1,267,495 | A | | 5/1918 | Babick | |
| 1,355,122 | A | | 10/1920 | Bintliff | |
| 1,864,931 | A | * | 6/1932 | Pritchard | 220/565 |
| 2,128,297 | A | | 8/1938 | Ingersoll | |
| 2,148,278 | A | | 2/1939 | Rose | |
| 2,189,945 | A | | 2/1940 | Fitch | |
| 2,254,964 | A | * | 9/1941 | Kettlewell | 220/445 X |
| 2,402,175 | A | * | 6/1946 | Mapes | 220/565 X |
| 2,643,022 | A | * | 6/1953 | Cornell | 220/469 X |
| 2,675,940 | A | * | 4/1954 | Schmitz | 220/565 X |
| 2,754,992 | A | | 7/1956 | Wilson | |
| 2,777,295 | A | | 1/1957 | Bliss et al. | |
| 2,863,297 | A | * | 12/1958 | Johnston | 220/445 X |
| 2,869,751 | A | * | 1/1959 | Klope et al. | 220/445 |
| 2,892,564 | A | | 6/1959 | Morrison | |
| 2,963,191 | A | * | 12/1960 | Setzekorn et al. | 220/4.12 X |
| 3,038,232 | A | * | 6/1962 | Wean | 220/445 X |
| 3,101,861 | A | * | 8/1963 | Mearns, III et al. | 220/444 |
| 3,118,559 | A | | 1/1964 | Stucker, Jr. | |
| 3,151,416 | A | | 10/1964 | Eakin et al. | |
| 3,337,079 | A | * | 8/1967 | Clarke et al. | 220/445 |
| 3,338,010 | A | * | 8/1967 | Waugh | 220/565 X |
| 3,446,388 | A | * | 5/1969 | Greenberg | 220/445 X |
| 3,473,689 | A | * | 10/1969 | Hutter | 220/565 |

(List continued on next page.)

FOREIGN PATENT DOCUMENTS

| | | | | |
|---|---|---|---|---|
| JP | 0132098 | * | 6/1987 | 220/565 |

OTHER PUBLICATIONS

Article "What is Mica", GMS Industrial Pty Ltd at http://www.generalmica.com.au/info.html.

*Primary Examiner*—Steven Pollard
(74) *Attorney, Agent, or Firm*—Gregory L. Roth

(57) ABSTRACT

A liquid container for the above-ground storage of flammable fuels is shown having an inner tank with a bottom surface, side surfaces, and a top surface placed within an outer shell having a bottom surface, side surfaces, and an open top. The bottom surfaces of the inner tank and outer shell are spaced apart from each other by first bottom spacers which connect the two bottom surfaces. The side walls of the inner tank and outer shell are also spaced apart from each other by second side spacers which connect the tank and shell. The side spacers for connecting the tank and shell prevent the inner tank from floating within the outer shell when an insulating material, such as concrete, is added therebetween.

56 Claims, 3 Drawing Sheets

U.S. PATENT DOCUMENTS 3,666,132 A * 5/1972 Yamamoto et al. ..... 220/444 X
3,848,765 A * 11/1974 Dürkop ..... 220/469 X
3,882,591 A * 5/1975 Yamamoto ..... 220/444 X
3,922,987 A 12/1975 Tornay
3,938,689 A * 2/1976 de Munnik ..... 220/565 X
4,015,393 A 4/1977 Warwick
4,342,713 A 8/1982 Larkfeldt
4,374,478 A 2/1983 Secord
4,579,249 A * 4/1986 Patterson et al. ..... 220/445
4,638,920 A 1/1987 Goodhues, Jr.
4,651,893 A 3/1987 Mooney
4,826,644 A * 5/1989 Lindquist et al. ..... 264/71
4,844,287 A 7/1989 Long
4,871,081 A * 10/1989 Ershig ..... 220/565
4,890,983 A 1/1990 Soloman et al. ..... 417/41
4,895,272 A 1/1990 Benedittis et al.
4,912,966 A 4/1990 Sharp
4,915,545 A * 4/1990 Ferrari ..... 220/444 X
4,948,340 A 8/1990 Solomon et al. ..... 417/41
4,960,151 A * 10/1990 Kaminski et al. ..... 206/509 X
4,974,739 A 12/1990 Gelin
4,986,436 A * 1/1991 Bambacigno et al. ... 220/565 X
4,989,750 A 2/1991 McGarvey ..... 220/444
4,991,613 A 2/1991 Kaminski et al.
5,004,632 A 4/1991 McGarvey et al.
5,012,949 A * 5/1991 McGarvey et al. ..... 220/455
5,016,689 A 5/1991 McGarvey et al. ..... 141/198
5,038,456 A 8/1991 McGarvey ..... 29/460
5,056,017 A 10/1991 McGarvey ..... 364/403
5,071,166 A 12/1991 Marino
5,103,996 A * 4/1992 McGarvey ..... 220/565 X
5,271,493 A 12/1993 Hall
5,282,546 A 2/1994 Bauer

* cited by examiner

TANK VAULT

This application is a continuation of application Ser. No. 08/028,213, filed on Mar. 9, 1993, now abandoned, which is a continuation of application Ser. No. 07/946,026, file on Sep. 15, 1992, now U.S. Pat. No. 5,271,473, which is a continuation of application Ser. No. 07/759,703, filed on Sep. 11, 1991, now abandoned, which is a continuation of application Ser. No. 07/664,411, filed on Feb. 27, 1991, now abandoned, which is a continuation of application Ser. No. 07/452,690, filed Dec. 19, 1989, now abandoned.

BACKGROUND OF THE INVENTION

The present invention relates to a vaulted tank and, more particularly, to an above-ground storage tank for flammable liquids.

Since the 1970s, the world and the United States have been concerned with the environment and the contamination of that environment, including the earth's soil, its atmosphere and its water. The first Earth Day in 1970 resulted in the eventual creation of the Environmental Protection Agency by the United States Congress.

One of the many problems which the Environmental Protection Agency has addressed is the deterioration of large, underground storage tanks which result in the leakage of contaminants into the soil, such as the deterioration of gas station storage tanks and the leakage of gasoline and diesel fuel into the surrounding water table.

To correct this problem, the EPA has suggested that all fuel storage tanks be placed above ground. This has created a classic confrontation between governmental departments. For example, the fire departments of most major cities prefer that fuel storage tanks be placed below ground to reduce fire hazard. Most municipal codes have been drafted with this concern in mind. In more recent years, the creation of large concrete entombed tanks has been suggested as a solution to the problem. That is, a gasoline storage tank may be entombed in concrete and placed above the ground to enable its surfaces to be easily checked for deterioration and fluid leakage. By entombing the fuel tank in concrete, the tank is made impervious to impact from a vehicle that might back into it, for example, and resistant to fire due to the insulating ellect fo the concrete. One example of such an entombed tank is shown in U.S. Pat. No. 4,826,644, issued May 2, 1989 to T. R. Lindquist and R. Bambacigno.

The concrete entombed tank has several disadvantages including cost and convenience. For example, a 1,000-gallon concrete entombed tank weighs 18,000 pounds after it has been manufactured. Such a tank requires a large truck and crane with at least two 20-ton nylon straps to transport the tank to the site where it is to be used and to then place the tank in the desired position. The concrete entombed tank is provided with bottom supporting feet to permit the inspection of its bottom surface during its use. In California, where earthquakes represent a real concern, concrete shoes are placed on the site on either side of the bottom supporting feet to prevent the movement of the tank during an earthquake. The placement of the concrete tank between the concrete shoes can be a very dangerous procedure in view of the tank's weight.

SUMMARY OF THE INVENTION

Accordingly, it is an object of the present invention to provide a less expensive, lighter weight and more easily transported tank vault for the above-ground storage of liquid fuels, such as gasoline and diesel fuel.

This object and other objects are accomplished by providing an inner tank having a bottom surface, side surfaces, and a top surface which is placed within an outer shell having a bottom surface, side surfaces, and an open top. The bottom surface of the inner tank is spaced apart from and connected to the bottom surface of the outer shell by first, bottom spacers which do not extend to the side surfaces of either the inner tank or outer shell. The side surfaces of the inner tank and outer shell are spaced apart and attached to one another by second side spacers which do not extend to the bottom surface of either the inner tank or outer shell. The side spacers function to prevent the inner tank from floating within the outer shell when an insulating material, such as concrete, is placed therebetween.

The utilization of an inner tank and outer shell with appropriate bottom and side spacers for attaching the two permits the assembled tank to be shipped from the factory to the site where it is intended for use with relative ease because of its light weight. Once properly placed upon the site, the space between the inner tank and outer shell can be filled with a suitable insulation material to meet the strength and insulation requirements of the fire codes of all metropolitan areas. Spacing feet on the bottom surface of the out shell permit all surfaces of the tank vault to be inspected to assure that the tank does not deteriorate and leak. This meets the requirements of the Environmental Protection Agency.

DESCRIPTION OF THE DRAWINGS

A better understanding of the present invention and of additional advantages and objects will be had after consideration of the following specification and drawings, wherein.

DESCRIPTION OF THE PREFERRED EMBODIMENTS

Figure 2:
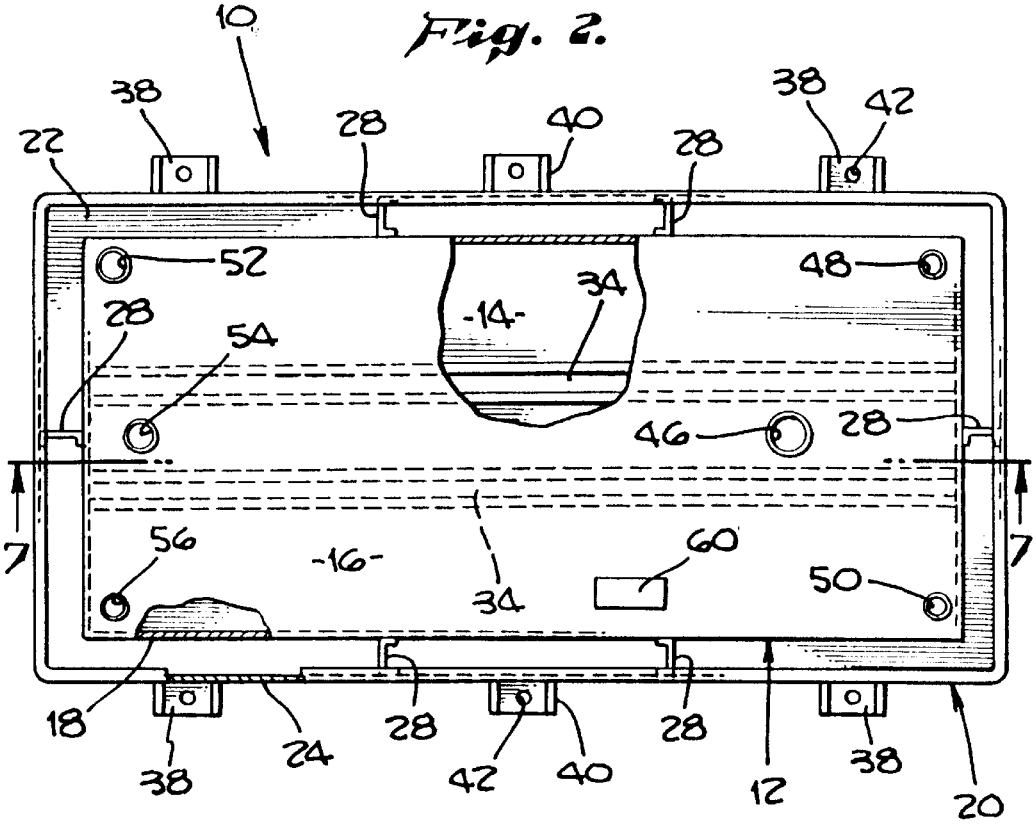
FIG. 2 is a top plan view thereof.

Referring now to the drawings, a tank vault 10 is shown in all figures having an inner tank 12 including a bottom surface 14, top surface 16 and side surfaces 18. The inner tank may be constructed from various types of material including steel, corrosion-resistant steel, aluminum, cast iron, fiberglass, fiberglass-reinforced steel, and polyethylene. In the preferred embodiment, the inner tank is constructed from 3/16-inch thick steel.

The inner tank 12 is spaced apart from an outer shell 20 which also has a bottom surface 22 and side surfaces 24, while the top of the outer shell 20 is open. In the preferred embodiment, the outer shell is made of 10 gauge steel. The inner tank 12 and outer shell 20 are attached in a spaced apart relationship by a first, bottom spacer 26 which, in the preferred embodiment, may be constructed from a C-shaped steel channel that is six inches long and weighs 8.2 pounds per foot (C×6×8.2). This same C-shaped channel may also be used as a second side spacer 28 which attaches and spaces the side surfaces 18 and 24 of the inner tank and outer shell.

Figure 6:
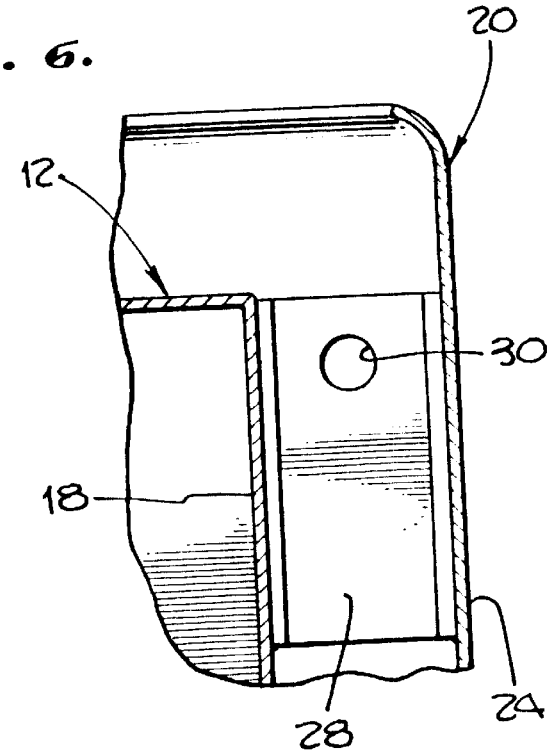
FIG. 6 is a detailed view of the side spacers between the inner tank and outer shell.

The first, bottom spacer 26 may be attached to the bottom surface 14 of inner tank 12 by welding. Similarly, the second side spacers 28 may be attached to the side surfaces or walls 18 of inner tank 12 by welding. The inner tank 12 may then be lowered into the outer shell 20 and the first, bottom spacers 26 attached to the bottom surface 22 of the outer shell 20 by welding plugs which are formed by welding through small holes in the bottom surface 22 directly to the lower surface of the bottom spacers 26 to fill the holes and thus produce the welding plug for the attachment of the spacers 26. Generally, it is not necessary to use welding plugs to attach the second, side spacers 28 to the side surfaces 24 of outer shell 20, as seen in FIG. 6. FIG. 6 shows an aperture 30 in the side spacer 28 which may be used to secure a hook for lifting the assembled tank vault 10 from a truck and placing it at the desired location upon the site where the tank vault 10 is to be used. It will also be seen in FIG. 6 that the upper edges of the side walls 24 of outer shell 20 are each provided with a radius which establishes a smooth rounded upper edge of the tank vault 10 once the insulating material, such as concrete, is poured between the inner tank 12 and outer shell 20. It will also be seen in FIGS. 1, 6 and 7 that the side spacers 28 do not extend to the bottom surfaces 14 or 22 of the inner tank 12 or outer shell 20. Similarly, the bottom spacer 26 does not extend to the side walls 24 of outer shell 20. This permits the insulation material to flow completely between the inner tank 12 and outer shell 20.

The preferred embodiment shows an inner tank 12 in the shape of a rectangular block with the outer shell 20 also shaped as a rectangular block. Other configurations are possible within the teachings of the present invention, including a cubically-shaped inner tank and outer shell or a cylindrically-shaped inner tank mounted within an outer shell in the form of a rectangular block. In this latter arrangement, the bottom surface of the inner tank is the bottom edge of the cylindrical shape while the side walls include the two side edges of the cylinder and the two flat ends thereof.

It has been found that the second, side supports 28 are very important in the fabrication of the inner tank 12 and outer shell 20 in that the pouring of the insulating material, such as concrete, can cause the inner tank 12 to float within the outer shell 20. This problem has not occurred in the prior art as the prior art generally does not contemplate such large volume when fabricating the inner and outer tanks. Further, the prior art does not contemplate the problems that would be experienced when an insulating material, such as concrete, is poured to fill the space between the inner tank 12 and the outer shell 20. Such problems include the possible bowing of either the inner side walls 14 or the outer side walls 20 of tank 12 and shell 20 and the collapse of the top surface 16 of tank 12. To eliminate this problem, inner supports are utilized, including inner side supports 32, shown in FIGS. 1, 3, 4, 5 and 7, and inner top supports 34, shown in FIGS. 1, 2 and 4. In the preferred embodiment, the inner side supports 32 are made of 10 gauge steel sheets with a hat-shaped cross-section having a three inch crown, one inch sidewalls and a one inch brim on the outer edge of each side wall. In the preferred embodiment, the inner top supports 34 are formed from the same material and in the same shape.

Figure 7:
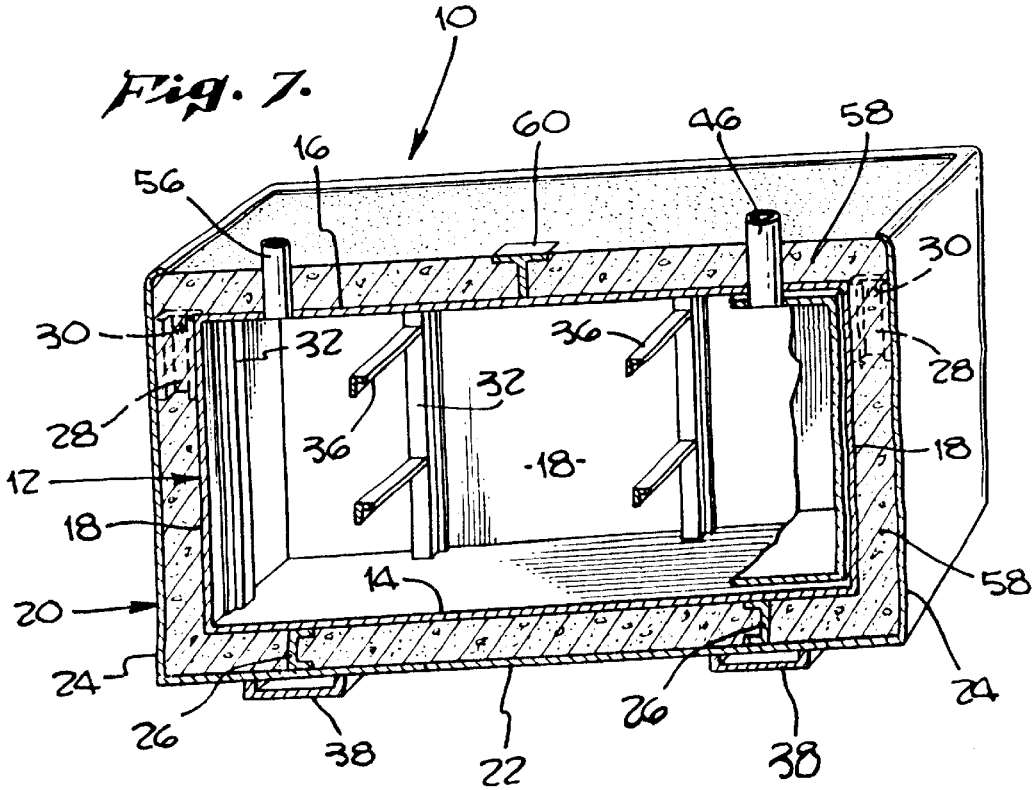
FIG. 7 is a cross-sectional view taken along line 7—7 of FIG. 2 shown in perspective after insulating material, such as concrete, has been poured between the inner tank and outer shell of the tank vault.

Further support is provided to the side surfaces 18 of inner tank 12 by cross-rib supports 36 seen in FIGS. 3, 4, 5 and 7. It will be seen in FIGS. 3 and 4 that the preferred embodiment may include three pairs of cross-rib supports which attach opposite side walls 18 of the inner tank 12 at the inner side supports 32. As seen in FIG. 7, the cross-rib supports 36 are formed from a 2×2×¼-inch angle channel which is attached to the inner supports 32, as by welding. Similarly, the inner side supports 32 and top supports 34 are attached to the side surfaces 18 and top surface 16 of the inner tank 12 by welding.

Figure 3:
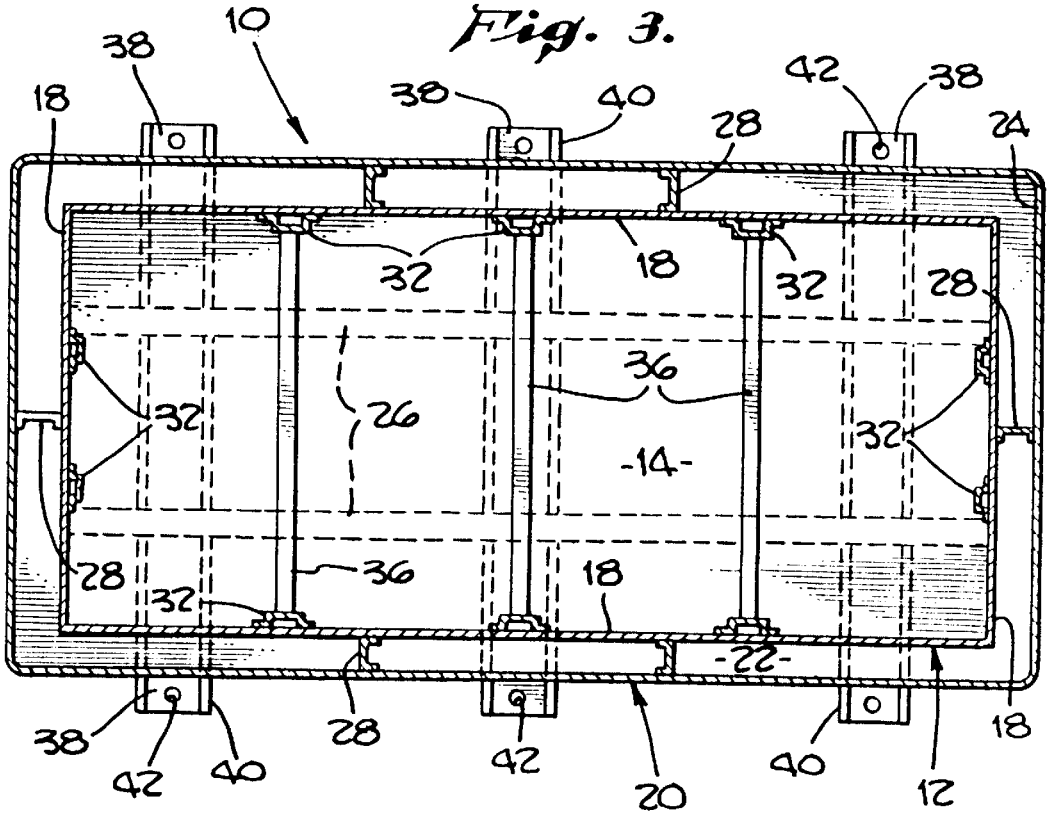
FIG. 3 is a cross-sectional view taken along line 3—3 of FIG. 1.
Figure 4:
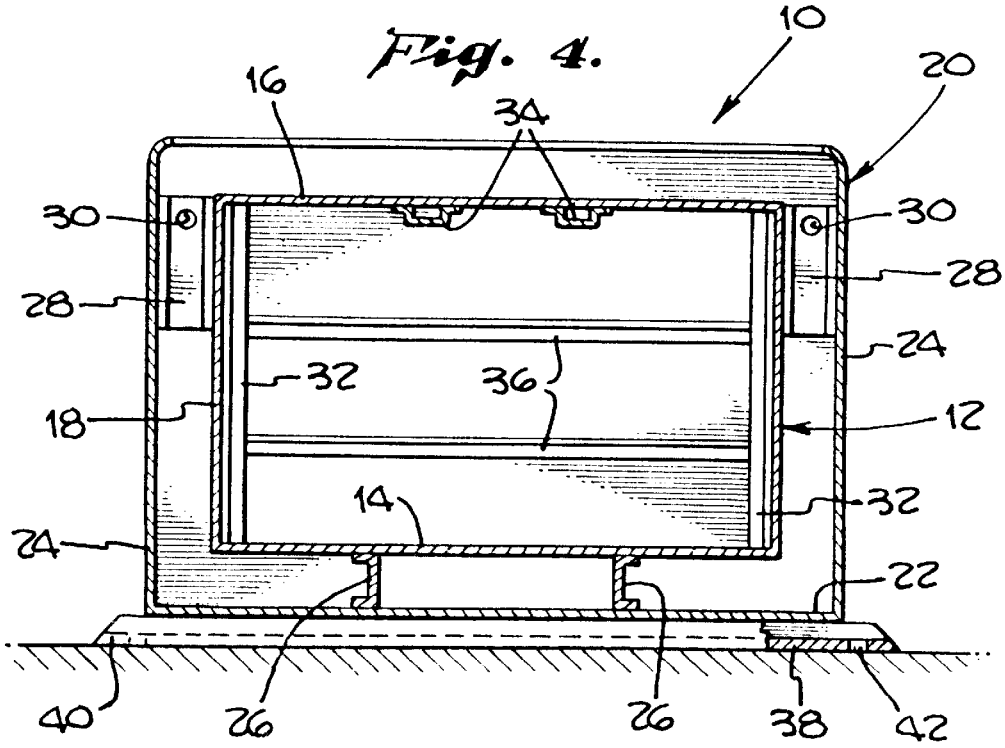
FIG. 4 is a cross-sectional view taken along line 4—4 of FIG. 1.
Figure 5:
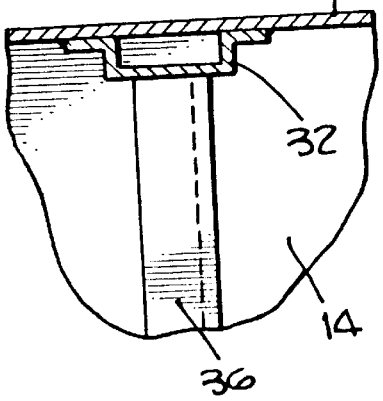
FIG. 5 is a detailed view showing the inner support ribs of the inner tank.

To complete the prefabricated assembly of the tank vault 10, a third set of spacers or mounting feet 38, seen in FIGS. 1, 2, 3, 4 and 7, are attached to the bottom surface 22 of outer shell 20, as by welding. These mounting feet 38 may be formed from the same C-shaped channel that forms the bottom and side spacers 26 and 28. As best seen in FIGS. 2, 3 and 4, the mounting feet 38 extend beyond the width of the outer shell 20 to form extensions 40 into which apertures 42 have been placed, as seen in FIG. 3. These apertures receive suitable lag bolts or other fasteners which may be driven into a concrete mounting pad or other suitable mounting surface upon which the tank vault 10 is ultimately placed. The extensions 40 thus provide a convenient way for securing the tank vault 10 to the surface of its mounting site to prevent the tank 10 from walking during an earthquake.

Figure 1:
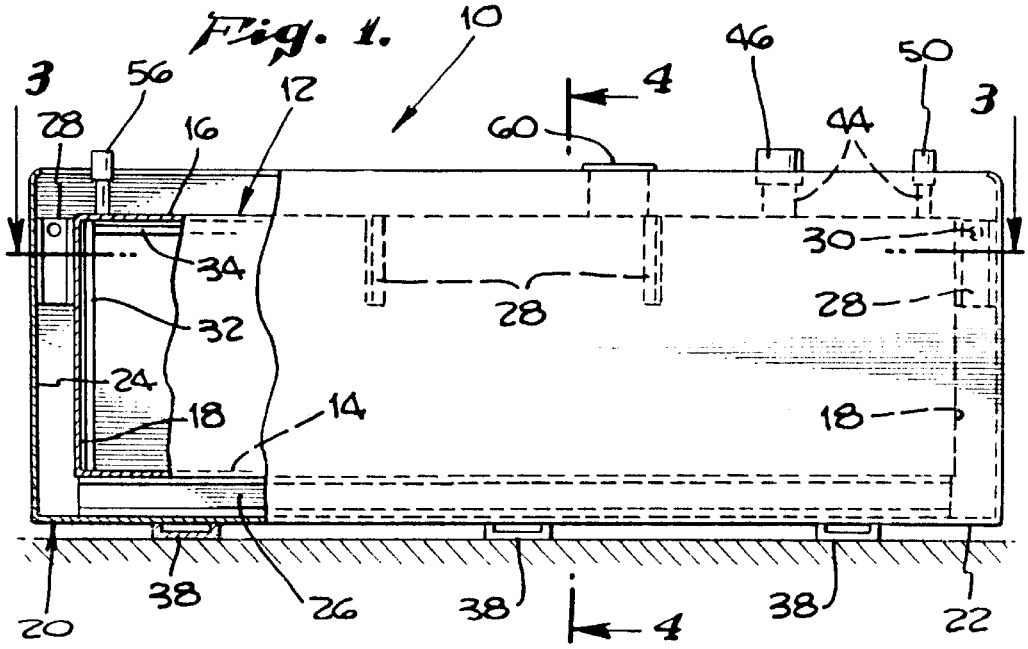
FIG. 1 is a side elevational view of the tank vault of the present invention.

As best seen in FIGS. 1 and 2, the top surface 16 of inner tank 12 is provided with several apertures into which various sized pipe fittings 44 may be attached, as by welding. The purpose of these pipe fittings 44 are many and varied. In the preferred embodiment shown in FIG. 2, they include the following: a six-inch tank bung 46 located in the center of the right-hand portion of the top surface 16 for mounting a 2.5-pound emergency vent; a two-inch tank bung 48 located in the upper, right-hand corner of the top surface 16 for a vent; a two-inch tank bung 50 located in the lower, right-hand surface of tank cover 16 to mount a sight level gauge; a four-inch tank bung 52 in the upper, left-hand corner of top surface 16 for a phase one vapor recovery device; a four-inch tank bung 54 in the center, left-hand section of the top surface 16 for filling the tank 10; and a two-inch tank bung 56 in the lower, left-hand corner of surface 16 for a gas pump.

The tank vault 10 shown in FIGS. 1–7 weighs approximately 2,400 pounds in the prefabricated state as shown in FIGS. 1–6 and holds 1,000 gallons. The reader will understand that several variations of the tank structure are possible and that the specific shape and sizes of the inner and outer tanks, the bottom spacers 26, side spacers 28, mounting feet 38, side supports 32, top supports 34, and cross-rib supports 36 may all vary within the teachings of the present invention. Further, the inner tanks 12 may be fabricated with a double sided top, sides and bottom as shown in FIG. 7. The size of the tank vault 10 may also vary to accommodate many volumes, such as 250, 500, 1,000 and 2,000 gallons.

In the present invention, it is anticipated that the 250 gallon tank vault 10 will have an inner tank 12 with a length of 80 inches, a height of 25 inches, and a width of 30 inches. The dimensions of the outer shell 20 will include a length of 92 inches, a height of 37 inches, and a width of 42 inches. This 250 gallon tank will have a single side spacer 28 that is 12 inches long and two sets of vertical inner side supports 32 with a single cross-rib support 36 between each. The 500 gallon tank 10 has an inner tank dimension of 120 inches long by 26 inches high by 37 inches wide, and an outer shell dimension of 132 inches long by 38 inches high by 49 inches wide. Along the length of the side walls 18 and 24 of the inner tank 12 and outer shell 20 are two side spacers 28, while the inner side supports 32 number three along the long side wall with single cross-rib supports 36 therebetween. The 1,000 gallon tank has ah inner tank dimension of 120 inches long by 46 inches high by 42 inches wide with the outer shell dimensions being 132 inches by 58 inches by 54 inches. The inner supports are the same as for the 500 gallon tank except that there are two cross-rib supports 36 between each of the inner side supports 32 rather than one. A 2,000 gallon tank includes an inner tank 12 with a length of 120 inches, a height of 55 inches, and a width of 70 inches; while the outer shell measures 132 inches long by 67 inches high by 82 inches wide. The side supports 28 are twice as long as the side supports within the 1,000 gallon tank, while the inner side supports 32 and cross-rib supports are the same in number as for the 1,000 gallon tank. Each tank has the same number of bottom spacers 26 for providing a standoff between the inner tank and outer shell. The 250 gallon tank has two mounting feet 38, while the remaining tanks have three.

After the tank vault 10 has been properly placed at the desired site, the space between inner tank 12 and outer shell 20 may be filled with a suitable insulating material 58, shown in FIG. 7. In the preferred embodiment, this insulating material is concrete. However, other materials may be used including cement, sand, gravel, a heat-resistant plastic such as polyethylene, or a fire-retardant foam. In general, the material should be fire-resistant and meet or exceed a two-hour firewall rating. In some situations, such as when the tank is intended to be used to store waste oil, for example, it may not be necessary to fill the space between the inner and outer tanks with any insulating material 48. As the insulating material 58 is poured into the space between the inner tank 12 and outer shell 20, the tanks are vibrated by a suitable vibrating tool to ensure that all spaces between the tank and shell are filled. The outer shell is then filled to a level equal to the upper edge of its side walls 24 so that the rounded edges thereof are flush with the upper surface of the insulating material. A T-shaped standoff 60 may be attached to the top surface 16 of inner tank 12, as by welding. It will be seen that the standoff 60 is flush with the upper surface of the insulating material 58. This standoff 60 thus provides a mounting platform upon which to place a nameplate or other information. Once filled with concrete 58, for example, a gasoline pump, not shown, may be mounted to the side surface 24 of the outer shell 20 and connected to the two-inch tank bung 56.

As discussed above, many shapes of the inner tank 12 and outer shell 20 are possible. The inner tank 12 may be constructed from several different materials and the space between it and the outer shell 20 may be varied and filled with several different insulating materials within the teaching of this invention. Further, the shape, number, configuration and material of the bottom spacers 26, side spacers 28, inner side supports 32, inner top supports 34, cross-rib supports 36, and mounting feet 38 may vary within the teachings of this invention. It will also be noted that the placement of the inner side supports 32 within the inner tank 12 is usually such that they do not align themselves with the side supports 28 thereby increasing the rigidity of the side walls 18. In view of the number of variations possible within the tank vault of the present invention, that invention should be limited only by the appended claims.

I claim:

1. An above-ground storage tank for storing a flammable liquid comprising:

a 10 gauge steel outer shell having a bottom surface, side surfaces, and an open top;

a 3/16 inch thick steel inner tank having a bottom surface, side surfaces, and a top surface, the inner tank being disposed within the outer shell, the bottom surface of the inner tank being spaced apart 6 inches from the bottom surface of the outer shell, the side surfaces of the inner tank being spaced apart 6 inches from the side surfaces of the outer shell to form a space between the inner tank and the outer shell;

a plurality of bottom spacers disposed between the spaced apart bottom surfaces of the inner tank and the outer shell without extending to the side surfaces of either the inner tank or the outer shell, each bottom spacer being attached to the bottom surface of the inner tank and to the bottom surface of the outer shell;

a plurality of side spacers disposed between the spaced apart side surfaces of the inner tank and the outer shell without extending to the bottom surface of either the inner tank or the outer shell, each side spacer being attached to a side surface of the inner shell and being attached to a side surface of the outer shell, the plurality of side spacers preventing the inner tank from floating within the outer shell, at least two of the plurality of side spacers being disposed on opposite sides of the inner shell and having an aperture therethrough for receiving a hook for lifting the storage tank;

an initially pourable, fire-resistant insulating material disposed to completely fill the space between the inner tank and the outer shell;

a plurality of hat-shaped 10 gauge steel vertically extending side supports attached to the inner surfaces of the inner tank to strengthen the sides of the inner tank, at least one hat-shaped 10 gauge steel horizontally extending top support attached to the inner surface of the top of the inner tank to strengthen the top of the inner tank;

a plurality of horizontally extending cross-rib supports having opposite ends attached to side supports on opposite sides of the inner tank;

a plurality of C-channel shaped spacers attached to the bottom surface of the bottom of the outer shell, each spacer having two extension portions that extend beyond respective opposite sides of the outer shell, each extension portion having an aperture therethrough for receiving a mounting fastener; and a plurality of pipe fittings attached to the top of the inner tank.

2. An above-ground storage tank for storing a flammable liquid as set forth in claim 1, wherein the inner tank has a capacity of at least 250 gallons.

3. An above-ground storage tank for storing a flammable liquid as set forth in claim 1, wherein the inner tank has a capacity of at least 1,000 gallons.

4. An above-ground storage tank for storing a flammable liquid comprising:

a steel outer shell having a bottom surface, side surfaces, and an open top;

a steel inner tank having a bottom surface, side surfaces, and a top surface, the inner tank being disposed within the outer shell, the bottom surface of the inner tank being spaced apart 6 inches from the bottom surface of the outer shell and the side surfaces of the inner tank being spaced apart 6 inches from the side surfaces of the outer shell to form a space between the inner tank and the outer shell;

at least one bottom spacer disposed between the spaced apart bottom surfaces of the inner tank and the outer shell without extending to the side surfaces of either the inner tank or the outer shell, the at least one bottom spacer maintaining the space between the bottom surface of the inner tank and the bottom surface of the outer shell;

a plurality of side spacers disposed between the spaced apart side surfaces of the inner tank and the outer shell without extending to the bottom surface of either the inner tank or the outer shell, each side spacer being attached to a side surface of the inner shell and being attached to a side surface of the outer shell to maintain the space therebetween, the plurality of side spacers preventing the inner tank from floating within the outer shell, at least two of the plurality of side spacers being disposed on opposite sides of the inner shell and having an aperture therethrough for receiving a hook for lifting the storage tank;

initially pourable, fire-resistant insulating material disposed to fill the space between the inner tank and the outer shell;

a plurality of hat-shaped 10 gauge steel vertically extending side supports attached to the inner surfaces of the inner tank to strengthen the sides of the inner tank, at least one hat-shaped 10 gauge steel horizontally extending top support attached to the inner surface of the top of the inner tank to strengthen the top of the inner tank;

a plurality of horizontally extending cross-rib supports having opposite ends attached to side supports on opposite sides of the inner tank; and a plurality of C-channel shaped spacers attached to the bottom surface of the bottom of the outer shell, each spacer having two extension portions that extend beyond respective opposite sides of the outer shell, each extension portion having an aperture therethrough for receiving a mounting fastener.

5. An above-ground storage tank for storing a flammable liquid comprising:

a closed inner tank for storing a flammable liquid, the inner tank having at least a bottom surface, side surfaces, and a top surface defining the inner tank;

a metal outer shell having at least a bottom surface and side surfaces for housing the inner tank, the outer shell having a given thickness of at least 10 gauge and an open top;

first means for spacing the bottom surface of the inner tank from the bottom surface of the outer shell;

second means for spacing the side surfaces of the inner tank from the side surfaces of the outer shell, the first and second spacing means providing a space between the inner tank and the outer shell that is greater than the thickness of the outer shell, the space being provided between the bottom and side surfaces respectively of the inner tank and the outer shell;

at least one pipe fitting attached to the inner tank and providing communication between the inside and outside of the inner tank; and fire resistant insulating material that includes cement disposed within and filling the space between the inner tank and the outer shell.

6. An above-ground storage tank for storing a flammable liquid comprising:

an inner tank for storing a flammable liquid, the inner tank being shaped as a rectangular block and having at least a bottom surface and side surfaces defining the inner tank;

an outer shell having at least a bottom surface and side surfaces for housing the inner tank, the outer shell being shaped as a rectangular block and having a given thickness of at least 10 gauge;

first means for spacing the bottom surface of the inner tank from the bottom surface of the outer shell;

second means for spacing the side surfaces of the inner tank from the side surfaces of the outer shell, the first and second spacing means providing a space between the inner tank and the outer shell that is greater than the thickness of the outer shell, the space being provided between the bottom and side surfaces respectively of the inner tank and the outer shell;

at least one pipe fitting attached to the inner tank and providing communication between the inside and outside of the inner tank; and fire resistant insulating material that includes cement disposed within and filling the space between the inner tank and the outer shell.

7. An above-ground storage tank for storing a flammable liquid comprising:

an inner tank for storing a flammable liquid, the inner tank being cylindrical in shape and having at least a bottom surface and side surfaces defining the inner tank;

a steel outer shell having at least a bottom surface and side surfaces for housing the inner tank, the outer shell being cylindrical in shape and having a given thickness of at least 10 gauge;

first means for spacing the bottom surface of the inner tank from the bottom surface of the outer shell;

second means for spacing the side surfaces of the inner tank from the side surfaces of the outer shell, the first and second spacing means providing a space between the inner tank and the outer shell that is greater than the thickness of the outer shell, the space being provided between the bottom and side surfaces respectively of the inner tank and the outer shell;

at least one pipe fitting attached to the inner tank and providing communication between the inside and outside of the inner tank; and fire resistant insulating material that includes cement disposed within and filling the space between the inner tank and the outer shell.

8. An above-ground vaulted storage tank for storing a flammable liquid comprising:

an inner tank for storing a flammable liquid, the inner tank having at least a bottom surface and side surfaces defining the inner tank;

an outer shell having at least a bottom surface and side surfaces for housing the inner tank, the outer shell having a given thickness;

first means for spacing the bottom surface of the inner tank from the bottom surface of the outer shell, the first means for spacing being attached to the bottom surface of the inner tank and to the bottom surface of the outer shell;

second means for spacing the side surfaces of the inner tank from the side surfaces of the outer shell, the second means for spacing being attached to the side surfaces of the inner tank and to the side surfaces of the outer shell, the first and second spacing means providing a space between the inner tank and the outer shell that is greater than the thickness of the outer shell, the space being provided between the bottom and side surfaces respectively of the inner tank and the outer shell;

at least one pipe fitting attached to the inner tank and providing communication between the inside and outside of the inner tank; and fire resistant insulating material that includes cement disposed within and filling the space between the inner tank and the outer shell.

9. An above-ground storage tank for storing a flammable liquid as set forth in claim 8, further comprising fire resistant insulating material covering the top of the inner tank and wherein the inner tank has a capacity of at least 1000 gallons.

10. An above-ground storage tank for storing a flammable liquid as set forth in claim 8, wherein the second means for spacing includes means for preventing the inner tank from floating within the outer shell as the fire resistant insulating material is added therebetween, wherein the inner tank has a length of at least 120 inches and wherein the outer shell is made of steel and has a thickness of at least 10 gauge.

11. An above-ground storage tank for storing a flammable liquid as set forth in claim 8, further comprising support means attached to the side surfaces of the inner tank to support the attached side surfaces and wherein the inner tank has a capacity of at least 500 gallons and wherein the outer shell is made of metal with a thickness of at least 10 gauge.

12. An above-ground storage tank for storing a flammable liquid as set forth in claim 5, further comprising means for supporting the side surfaces and the top surface of the inner tank and wherein the inner tank has a length of at least 120 inches and a capacity of at least 1000 gallons.

13. An above-ground storage tank for storing a flammable liquid comprising:

an inner tank for storing a flammable liquid, the inner tank having at least a bottom surface, side surfaces and a top surface defining the inner tank;

an outer shell having at least a bottom surface and side surfaces for housing the inner tank the outer shell having a given thickness;

first means for spacing the bottom surface of the inner tank from the bottom surface of the outer shell;

second means for spacing the side surfaces of the inner tank from the side surfaces of the outer shell, the first and second spacing means providing a space between the inner tank and the outer shell that is greater than the thickness of the outer shell, the space being provided between the bottom and side surfaces respectively of the inner tank and the outer shell;

at least one pipe fitting attached to the inner tank and providing communication between the inside and outside of the inner tank;

means for supporting the side surfaces and the top surface of the inner tank, the support means including a plurality of ribs, each having a hat-shaped cross section, mounted upon said side surfaces and said top surface; and an initially pourable and subsequently solid fire resistant insulating material that includes cement disposed within and filling the space between the inner tank and the outer shell.

14. An above-ground storage tank for storing a flammable liquid as set forth in claim 13, further comprising means for supporting the side surfaces and the top surface of the inner tank, the support means including a plurality of ribs, each having a hat-shaped cross section, mounted upon said side surfaces and said top surface wherein the support means includes L-shaped cross-ribs mounted between the hat-shaped cross section ribs mounted on opposite side surfaces and wherein the tank is a vaulted tank having the outer shell made of steel with a thickness of at least 10 gauge, wherein the inner tank has a storage capacity of at least 500 gallons and wherein the space between the inner tank and outer shell is at least 6 inches.

15. An above-ground storage tank for storing a flammable liquid as set forth in claim 13, wherein the second means for spacing the side surfaces of the inner tank from the side surfaces of the outer shell include apertures therein for receiving a hook for lifting the storage tank.

16. An above-ground storage tank for storing a flammable liquid as set forth in claim 13, additionally comprising a plurality of supporting feet attached to the bottom of the outer shell on the outside thereof to support the storage tank above a supporting surface.

17. An above-ground storage tank for storing a flammable liquid comprising:

a double-sided inner tank for storing a flammable liquid, the inner tank having at least a bottom surface and side surfaces defining the inner tank;

an outer shell having at least a bottom surface and side surfaces for housing the inner tank, the outer shell having a given thickness;

first means for spacing the bottom surface of the inner tank from the bottom surface of the outer shell;

second means for spacing the side surfaces of the inner tank from the side surfaces of the outer shell, the first and second spacing means providing a space between the inner tank and the outer shell that is greater than the thickness of the outer shell, the space being provided between the bottom and side surfaces respectively of the inner tank and the outer shell; and fire resistant insulating material that includes cement disposed within and filling the space between the inner tank and the outer shell.

18. An above-ground storage tank for storing a liquid consisting of gasoline or diesel fuel comprising:

a metal outer shell having walls forming a container;

a closed inner tank defining an interior space for storing a liquid consisting of gasoline or diesel fuel disposed within the outer shell, the inner tank having walls disposed in spaced relationship to the walls of the outer shell to form a space between the inner tank and the outer shell;

a pipe fitting attached to the inner tank and providing access to the interior of the inner tank; and a solid, nonpourable insulating material disposed within and filling the space between the inner tank and the outer shell.

19. An above-ground storage tank for storing a liquid as set forth in claim 18, wherein the insulating material is concrete and wherein the walls of the metal outer shell forming a container are made of steel.

20. An above-ground storage tank for storing a liquid from the group consisting of gasoline and diesel fuel comprising:

a metal outer shell having walls forming a container;

a closed inner tank disposed within the outer shell, the inner tank having walls disposed in spaced relationship to the walls of the outer shell to form a space of at least 6 inches between the inner tank and the outer shell;

a pipe fitting secured to and providing access to the inner tank; and a fire resistant, initially pourable and subsequently hardenable insulating material disposed within and filling the space between the inner tank and the outer shell.

21. An above-ground vaulted storage tank for storing a flammable liquid comprising:

metal outer shell having walls forming a container;

a closed, cylindrical inner tank for storing a flammable liquid disposed within the outer shell, the inner tank having a capacity of at least 1,000 gallons and having an interior defined by walls disposed in spaced relationship to the walls of the outer shell to form a space between the inner tank and the outer shell;

a pipe joint secured to the inner tank and providing access to the interior of the inner tank; and solid insulating material disposed within and filling the space between the inner tank and the outer shell.

22. An above-ground vaulted storage tank for storing a flammable liquid comprising:

a metal outer shell having walls forming a container, the container forming walls having a thickness of at least 10 gauge;

a closed, cylindrical inner tank for storing a flammable liquid disposed within the outer shell, the inner tank having an interior defined by walls disposed in spaced relationship to the walls of the outer shell to form a space between the inner tank and the outer shell;

a pipe joint secured to the inner tank and providing access to the interior of the inner tank; and solid insulating material including cement disposed within and filling the space between the inner tank and the outer shell.

23. An above-ground vaulted storage tank for storing a liquid comprising:

a metal outer shell having walls forming a vaulted tank container;

a closed inner tank disposed within the outer shell, the inner tank having walls disposed in spaced relationship to the walls of the outer shell to form a space between the inner tank and the outer shell;

a plurality of pipe fittings secured to the inner tank on a top side thereof and providing access to the inside of the inner tank; and a solid fire resistant insulating material disposed within and filling the space between the inner tank and the outer shell.

24. An above-ground storage tank for storing a liquid as set forth in claim 23, wherein the insulating material includes sand and wherein the metal outer shell defines a container made of 10 gauge steel.

25. An above-ground storage tank for storing a liquid as set forth in claim 23, wherein the insulating material includes gravel and wherein the metal outer shell defines a container made of 10 gauge steel.

26. An above-ground storage tank for storing a liquid comprising:

a metal outer shell having walls forming a container;

a closed inner tank disposed within the outer shell, the inner tank having walls disposed in spaced relationship to the walls of the outer shell to form a space of at least 6 inches between the inner tank and the outer shell;

a plurality of pipe fittings secured to the inner tank on a top side thereof and providing access to the inside of the inner tank; and insulating material including cement disposed within and filling the space between the inner tank and the outer shell.

27. An above-ground vaulted storage tank for storing a liquid comprising:

a metal outer shell having walls forming a vaulted tank container;

a closed, cylindrical inner tank disposed within the outer shell, the inner tank having walls disposed in spaced relationship to the walls of the outer shell to form a space between the inner tank and the outer shell;

a plurality of pipe fittings secured to the inner tank on a top side thereof and providing access to the inside of the inner tank; and insulating material disposed within and filling the space between the inner tank and the outer shell.

28. An above-ground storage tank for storing a liquid as set forth in claim 27, wherein the insulating material includes a heat resistant plastic.

29. An above-ground storage tank for storing a liquid as set forth in claim 27, wherein the insulating material includes a fire retardant foam.

30. An above-ground vaulted storage tank for storing gasoline comprising:

a metal outer shell having walls forming a vaulted tank container;

a closed inner tank for storing gasoline disposed within the outer shell, the inner tank having walls disposed in spaced relationship to the walls of the outer shell to form a space between the inner tank and the outer shell;

a plurality of pipe fittings secured to the inner tank on a top side thereof and providing access to the inside of the inner tank; and fire resistant insulating material including cement disposed within and filling the space between the inner tank and the outer shell, the space having sufficient thickness to enable the storage tank to at least meet a two hour fire wall rating.

31. An above-ground vaulted storage tank for storing a flammable liquid comprising:

a metal outer shell having walls with a thickness of at least 10 gauge forming a container;

a closed inner tank for storing a flammable liquid inside thereof disposed within the outer shell, the inner tank having walls disposed in spaced relationship to the walls of the outer shell to form a space of at least 6 inches between the inner tank and the outer shell;

a pipe fitting secured to the inner tank and providing access to the inside of the inner tank; and a fire resistant insulating material disposed within and filling the space between the inner tank and the outer shell, the fire resistant insulating material being a material from a group of materials consisting of cement, sand, gravel, heat-resistant plastic, polyethylene and a fire retardant foam.

32. An above-ground storage tank for storing a liquid from a group consisting of gasoline and diesel fuel, the storage tank comprising:

a steel outer shell having walls with a thickness of at least 10 gauge forming a container;

a closed, cylindrical inner tank for storing a liquid from a group consisting of gasoline and diesel fuel, the inner tank being disposed within the outer shell, the inner tank having walls disposed in spaced relationship to the walls of the outer shell to form a space between the inner tank and the outer shell;

a pipe fitting attached to the inner tank and providing access to the inner tank; and insulating material disposed within and filling the space between the inner tank and the outer shell, the insulating material being a material from a group of materials consisting of cement, sand, gravel and a fire retardant foam.

33. An above-ground vaulted storage tank for storing a liquid comprising:

a steel outer shell having walls forming a container;

a closed inner tank disposed within the outer shell, the inner tank having steel walls disposed in spaced relationship to the walls of the outer shell to form a space between the inner tank and the outer shell;

a plurality of pipe fittings secured by welding to the inner tank on a top side thereof and providing access to the inside of the inner tank; and initially pourable, solid insulating material disposed within and filling the space between the inner tank and the outer shell, the insulating material completely enclosing the inner tank except for areas where the pipe fittings provide access to the inside of the inner tank.

34. An above-ground storage tank for storing a flammable liquid comprising:

a steel outer shell having walls forming a container;

a closed, steel inner tank for storing a flammable liquid disposed within the outer shell, the inner tank having walls disposed in spaced relationship to the walls of the outer shell to form a space of at least 6 inches between the inner tank and the outer shell;

a plurality of pipe fittings secured to the inner tank on a top side thereof and providing access to the inside of the inner tank; and fire resistant insulating material containing cement disposed within and filling the space between the inner tank and the outer shell.

35. An above-ground vaulted storage tank for storing a liquid comprising:

a metal outer shell having walls forming a container;

a closed, cylindrical inner tank disposed within the outer shell, the inner tank having steel walls disposed in spaced relationship to the walls of the outer shell to form a space between the inner tank and the outer shell;

a plurality of pipe fittings secured by welding to the steel inner tank on a top side thereof and providing access to the inside of the inner tank; and solid insulating material containing cement disposed within and filling the space between the inner tank and the outer shell.

36. An above-ground vaulted storage tank for storing a liquid comprising:

a steel outer shell having walls forming a container;

a closed, steel inner tank for storing a flammable liquid, the inner tank having a length of at least 120 inches, being disposed within the outer shell and having walls disposed in spaced relationship to the walls of the outer shell to form a space between the inner tank and the outer shell;

a plurality of pipe fittings secured to the inner tank on a top side thereof and providing access to the inside of the inner tank; and a solid fire resistant insulating material disposed within and filling the space between the inner tank and the outer shell, the space having sufficient thickness to enable the storage tank to meet a two hour fire wall rating.

37. An above-ground storage tank for storing a liquid comprising:

a steel outer shell having walls forming a container;

a closed, double walled, cylindrical inner tank having a liquid storage capacity of at least 250 gallons disposed within the outer shell, the inner tank having steel walls disposed in spaced relationship to the walls of the outer shell to form a space between the inner tank and the outer shell;

a plurality of pipe fittings secured by welding to the steel inner tank on a top side thereof and providing access to the inside of the inner tank; and insulating material disposed within and filling the space between the inner tank and the outer shell.

38. An above-ground vaulted storage tank for storing a flammable liquid comprising:

a steel outer shell having walls having a thickness of at least 10 gauge forming a container;

an inner tank for storing at least 500 gallons of a flammable liquid disposed within the outer shell, the inner tank having a steel top and having steel walls disposed in spaced relationship to the walls of the outer shell to form a space between the inner tank and the outer shell;

a plurality of pipe fittings secured by welding to the inner tank on a top side thereof and providing access to the inside of the inner tank; and solid insulating material disposed within and filling the space between the inner tank and the outer shell, the insulating material completely enclosing the inner tank except for areas where the pipe fittings provide access to the inside of the inner tank.

39. An above-ground vaulted storage tank for storing a liquid comprising:

a metal outer shell having walls forming a vaulted container;

a closed inner tank having a capacity of at least 1000 gallons disposed within the outer shell, the inner tank having walls disposed in spaced relationship to the walls of the outer shell to form a space between the inner tank and the outer shell; and fire resistant insulating material including cement disposed within and filling the space between the inner tank and the outer shell.

40. An above-ground storage tank for storing a liquid comprising:

a metal outer shell having walls forming a container;

a closed, cylindrical inner tank having a capacity of at least 500 gallons disposed within the outer shell, the inner tank having walls disposed in spaced relationship to the walls of the outer shell to form a space between the inner tank and the outer shell; and initially pourable, subsequently hardening insulating material containing cement disposed within and filling the space between the inner tank and the outer shell.

41. An above-ground storage tank for storing a flammable liquid comprising:

an outer metalic shell having a bottom wall and surrounding side walls defining a container, the shape of the outer shell being chosen from a group consisting of cubic and rectangular block shapes;

an inner tank for storing a flammable liquid, the inner tank having bottom, side, and top walls defining a closed liquid container, the inner tank being disposed within the outer shell with the bottom wall of the inner tank in opposed, spaced relationship to the bottom wall of the outer shell and with the side walls of the inner tank in spaced relationship to opposed side walls of the outer shell to form a space around the bottom and side walls of the inner tank that is adapted to receive a pourable insulating material, the shape of the inner tank being chosen from a group consisting of cubic, cylindrical and rectangular block shapes;

at least one bottom spacer disposed to maintain the spaced relationship between the bottom wall of the inner tank and the bottom wall of the outer shell, each bottom spacer being attached to the bottom wall of at least either the inner tank or outer shell;

a plurality of side spacers disposed to maintain the spaced relationship between the side walls of the inner tank and the opposed side walls of the outer shell;

a pipe fitting secured to the inner tank, the pipe fitting providing access to remove a flammable liquid from the inner tank; and initially pourable, solid insulating material disposed within the space around the bottom and side walls of the inner tank.

42. An above-ground storage tank for storing a flammable liquid as set forth in claim 41, herein each of the bottom spacers is welded to the bottom wall of the inner tank and to the bottom wall of the outer shell and wherein each side spacer is welded to a side wall of the inner tank and to an opposed side wall of the outer shell.

43. An above-ground storage tank for storing a flammable liquid as set forth in claim 41, wherein the bottom, side and top walls of the inner tank and the bottom and side wall of the outer shell are all made of steel.

44. An above-ground storage tank for storing a flammable liquid as set forth in claim 41, wherein the bottom, side and top walls of the inner tank are made of steel having a thickness of at least 3/16 inch and the bottom and side walls of the outer shell are all made of steel having a thickness of at least 10 gauge.

45. An above-ground storage tank for storing a flammable liquid as set forth in claim 41, wherein the insulating material includes a material selected from a group consisting of concrete, cement, plastic, polyethylene, and fire-retardant foam, wherein the inner tank has a length of at least 120 inches, wherein the bottom, side and top walls of the inner tank are made of steel having a thickness of at least 3/16 inch and the bottom and side walls of the outer shell are all made of steel having a thickness of at least 10 gauge.

46. An above-ground storage tank for storing a flammable liquid as set forth in claim 41, wherein the bottom, side and top walls of the inner tank are made of aluminum.

47. An above-ground storage tank for storing a flammable liquid as set forth in claim 41, wherein the bottom, side and top walls of the inner tank are made of fiberglass.

48. An above-ground storage tank for storing a flammable liquid as set forth in claim 41, wherein the inner tank is constructed of a material chosen from a group consisting of steel, corrosion-resistant steel, aluminum, cast iron, fiberglass, fiberglass-reinforced steel, and polyethylene.

49. An above-ground storage tank for storing a flammable liquid as set forth in claim 44, wherein the walls of the inner tank have a thickness of at least 3/16 inch.

50. An above-ground storage tank for storing a flammable liquid as set forth in claim 44, wherein said inner tank is a doubled-sided tank.

51. A process of forming a storage tank for above-ground storage of a flammable liquid, the process comprising the acts of:

forming a metal outer shell having a bottom and a plurality of side walls defining the outer shell;

forming an inner tank having a bottom and a plurality of side walls defining the inner tank;

placing the inner tank within the outer shell;

forming a space between the inner tank and the outer shell by placing a plurality of spacers between the bottom of the inner tank and the bottom of the outer shell and placing a plurality of spacers between side walls of the inner tank and opposed side walls of the outer shell;

transporting the result of the above stated recitations to a site where the storage tank is to be used; and after transporting the result of the above stated recitations to a site where the storage tank is to be used, filling the space between the inner tank and the outer shell with a pourable insulating material.

52. A process of forming a storage tank for above-ground storage of a flammable liquid as set forth in claim 51 further comprising forming a top on the inner tank, wherein the forming an outer shell forms an outer shell having side walls having upper edges, wherein the placing places the inner tank within the outer shell with the top of the inner tank below the upper edges of the side walls of the outer shell and wherein the filling includes covering the top of the inner tank with the pourable insulating material to a level equal to the upper edges of the side walls of the outer shell.

53. A process of forming an above-ground fire resistant storage tank for storing a liquid, the process comprising the acts of:

forming a metal outer shell with a bottom surface and surrounding side wall surfaces having upper edges which define a container having an opening for receiving an inner tank;

providing a closed inner tank for storing a liquid having bottom, top and side surfaces and including at least one aperture for receiving a liquid to be stored;

mounting the inner tank within the outer shell in spaced-apart relationship from the shell bottom and side wall surfaces to form a substantially continuous space therebetween, the inner tank being positioned within the outer shell by supports which extend between at least one side surface of the storage tank and a corresponding side surface of the outer shell in such a way as to permit the flow of a pourable insulating material into the substantially continuous space; and filling the substantially continuous space between the inner tank side and bottom surfaces and the outer shell side wall and bottom surfaces, respectively with a pourable insulating material to produce the above-ground fire resistant storage tank.

54. A process of forming an above-ground fire resistant storage tank for storing a liquid as set forth in claim 53, further comprising transporting the fire resistant storage tank to a desired site where the storage tank is to be used.

55. A process of forming an above-ground fire resistant storage tank for storing a liquid as set forth in claim 44, further comprising transporting the outer shell and the inner tank to a site where the storage tank is to be used before filling the substantially continuous space and thereafter filling the substantially continuous space with a pourable, subsequently solid insulating material containing cement.

56. An above-ground storage tank for storing a flammable liquid comprising:

an outer shell of a given thickness having at least a bottom and side walls defining the outer shell;

an inner tank for storing a flammable liquid inside thereof, the inner tank having at least a bottom and side walls defining the inner tank, the inner tank being disposed within the outer shell;

at least one pipe fitting attached to the inner tank and providing access to the inside of the inner tank from outside the outer shell;

first means for spacing the bottom of the inner tank from the bottom of the outer shell;

second means for spacing the side walls of the inner tank from the side walls of said outer shell, the first and second spacing means providing a space greater than the given thickness of the outer shell between the inner tank and the outer shell, the space being provided between the bottom and side walls respectively of the inner tank and the outer shell, the space between the inner tank and the outer shell having sufficient minimum thickness to at least meet a two-hour fire wall rating; and fire resistant insulating material disposed within and filling the space between the inner tank and the outer shell, the insulating material being a material that is initially pourable and that hardens after pouring, thereby becoming nonpourable.

* * * * *

UNITED STATES PATENT AND TRADEMARK OFFICE

CERTIFICATE OF CORRECTION

PATENT NO. : 6,422,413 B1
APPLICATION NO. : 08/348744
DATED : July 23, 2002
INVENTOR(S) : William Y. Hall and William A. Hall It is certified that error appears in the above-identified patent and that said Letters Patent is hereby corrected as shown below:

On Title page at (76) delete: "William A. Hall, 2104 Paseo Del Mar,
Palos Verdes Estates, CA (US) 90274"

and substitute: --William A. Hall
855 E. Twain #123-499
Las Vegas, NV 89169--

Signed and Sealed this
First Day of April, 2014

Michelle K. Lee

Michelle K. Lee
*Deputy Director of the United States Patent and Trademark Office*

US006422413C1

(12) EX PARTE REEXAMINATION CERTIFICATE (8680th)

United States Patent
Hall et al.

(10) Number: US 6,422,413 C1
(45) Certificate Issued: Nov. 22, 2011

(54) TANK VAULT

(75) Inventors: William Y. Hall, San Pedro, CA (US); William A. Hall, Palos Verdes Estates, CA (US)

(73) Assignee: The Hall Patent Group, LLC, Ennis, TX (US)

Reexamination Request:
No. 90/007,233, Oct. 4, 2004

Reexamination Certificate for:

| | |
|---|---|
| Patent No.: | **6,422,413** |
| Issued: | **Jul. 23, 2002** |
| Appl. No.: | **08/348,744** |
| Filed: | **Nov. 30, 1994** |

Related U.S. Application Data

(63) Continuation of application No. 08/028,213, filed on Mar. 9, 1993, now abandoned, which is a continuation of application No. 07/946,026, filed on Sep. 15, 1992, now Pat. No. 5,271,493, which is a continuation of application No. 07/759,703, filed on Sep. 11, 1991, now abandoned, which is a continuation of application No. 07/664,411, filed on Feb. 27, 1991, now abandoned, which is a continuation of application No. 07/452,690, filed on Dec. 19, 1989, now abandoned.

(51) Int. Cl.
*B65D 90/00* (2006.01)

(52) U.S. Cl. ..... 220/567.2; 220/565; 220/567.1; 220/4.12

(58) Field of Classification Search ..... 220/567.2, 220/4.12, 565, 567, 567.1, 560.1, 560.12, 220/560.15, 560.01, 562, 592.2, 592.25, 220/592.26, 62.15, 62.17, 62.22, 612, 628, 220/645, 651–653, 918, 921, DIG. 24
See application file for complete search history.

(56) References Cited

To view the complete listing of prior art documents cited during the proceeding for Reexamination Control Number 90/007,233, please refer to the USPTO's public Patent Application Information Retrieval (PAIR) system under the Display References tab.

*Primary Examiner*—Matthew C. Graham

(57) ABSTRACT

A liquid container for the above-ground storage of flammable fuels is shown having an inner tank with a bottom surface, side surfaces, and a top surface placed within an outer shell having a bottom surface, side surfaces, and an open top. The bottom surfaces of the inner tank and outer shell are spaced apart from each other by first bottom spacers which conect the two bottom surfaces. The side walls of the inner tank and outer shell are also spaced apart from each other by second side spacers which connect the tank and shell. The side spacers for connecting the tank and shell prevent the inner tank from floating within the outer shell when an insulating material, such as concrete, is added therebetween.

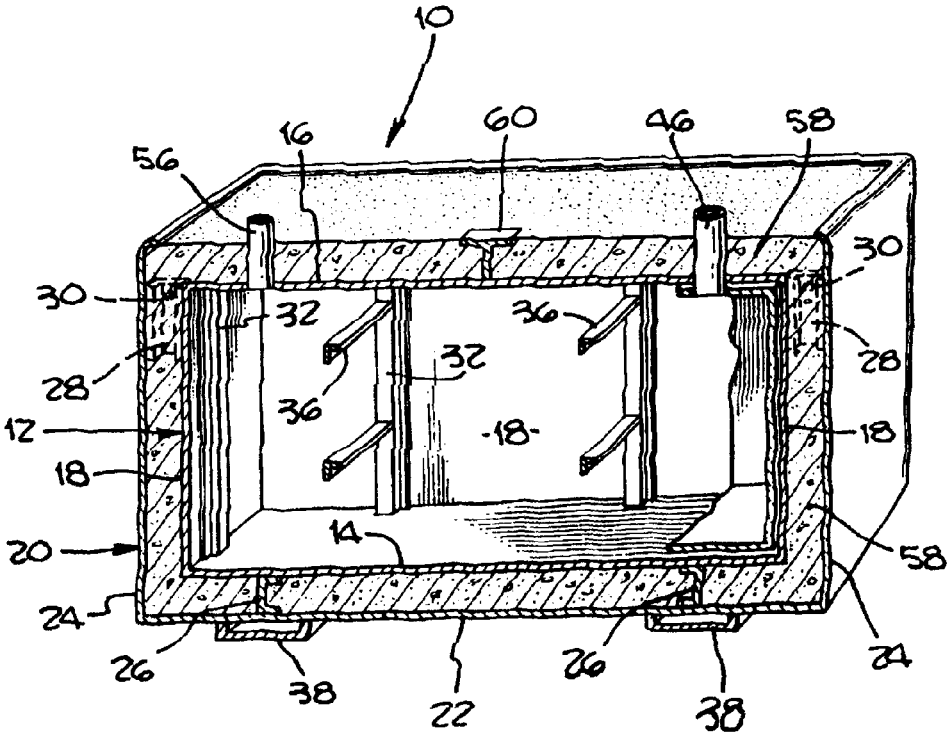

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-56 are cancelled.

* * * * *